United States Patent [19]

Tipton

[11] 4,158,029

[45] Jun. 12, 1979

[54] MEANS FOR POSITIONING A CARBURETOR FUEL METERING ROD

[75] Inventor: Larry J. Tipton, Florissant, Mo.

[73] Assignee: ACF Industries, Incorporated, New York, N.Y.

[21] Appl. No.: 836,527

[22] Filed: Sep. 26, 1977

[51] Int. Cl.[2] ..... F02M 7/22

[52] U.S. Cl. ..... 261/51; 261/69 R

[58] Field of Search ..... 261/51, 69 R

[56] References Cited

U.S. PATENT DOCUMENTS

| | | | |
|---|---|---|---|
| 2,711,885 | 6/1955 | Moseley et al. | 261/51 |
| 3,100,236 | 8/1963 | Ott et al. | 261/51 |
| 3,149,184 | 9/1964 | Szwargulski | 261/51 |
| 3,317,199 | 5/1967 | Reifel | 261/51 |
| 3,350,074 | 10/1967 | Kalert, Jr. et al. | 261/51 |

*Primary Examiner*—Tim R. Miles

*Attorney, Agent, or Firm*—J. Joseph Muller; Edward H. Casey

[57] ABSTRACT

A carburetor for an internal combustion engine has an air passage, a throttle valve movable in the air passage for controlling flow of air therethrough, a source of fuel, and a fuel passage through which fuel is drawn from the source to the air passage for mixing with air to produce an air-fuel mixture combusted in the engine. The fuel passage has an orifice at one end communicating with the fuel source. A metering rod has a diameter variable along its length and is positioned in the orifice in response to movement of the throttle valve thereby to control the quantity of fuel drawn through the fuel passage. The position of the metering rod in the orifice is varied in response to a change in the engine vacuum level when a change in the load on the engine occurs. The movement of the metering rod produced in response to a change in the engine vacuum level is limited thereby to limit the variation in quantity of fuel drawn through the fuel passage when a change in engine vacuum level occurs. When the engine vacuum level is less than a predetermined level, a relatively greater movement is produced in the position of the metering rod in the orifice than the limited movement whereby a relatively greater quantity of fuel is drawn through the fuel passage during cranking of the engine.

8 Claims, 5 Drawing Figures

MEANS FOR POSITIONING A CARBURETOR FUEL METERING ROD

BACKGROUND OF THE INVENTION

This invention relates to fuel flow in a carburetor for an internal combustion engine and more particularly to controlling the flow of fuel throughout a wide range of engine load conditions.

Fuel flow in a carburetor is usually controlled by positioning a fuel metering rod in an orifice between the carburetor's fuel bowl and a fuel passage through which fuel is drawn from the bowl to an air passage where it mixes with air to produce a mixture combusted in the engine on which the carburetor is installed. The position of the rod in the orifice is determined by a number of factors, among these being throttle valve position, engine load as evidenced by the engine vacuum level and atmospheric pressure (altitude). Thus, as the throttle valve opens or closes, more or less fuel, respectively must be supplied through the fuel passage; while if the throttle position is constant and the engine load changes, as when a vehicle starts up a hill, the position of the metering rod is varied to adjust or modulate the quantity of fuel supplied through the fuel passage for that throttle valve position. Because of the wide range in engine vacuum which occurs between engine starting, curb idle, normal cruise and wide-open throttle conditions; it has not been possible in the past to provide the range of metering rod movement necessary to obtain satisfactory fuel flow control for all conditions. The ability to modulate fuel flow during cruise conditions, for example, may prevent adequate control during starting so that less fuel is available for mixing with air and an insufficiently rich air-fuel mixture is supplied to the engine, making it difficult to start the engine.

SUMMARY OF THE INVENTION

Among the several objects of the present invention may be noted the provision of a carburetor in which movement of a fuel metering rod to control fuel flow in the carburetor is a function of the position of a throttle valve in an air passage of the carburetor and of the load on the engine on which the carburetor is installed; the provision of such a carburetor in which movement of the metering rod in response to changes in the load is limited thereby to limit variations in the flow of fuel; and the provision of such a carburetor in which relatively greater movement of the metering rod is produced at low engine vacuum levels, as, for example, during cranking of the engine to increase fuel flow in the carburetor and obtain a sufficiently rich air-fuel mixture to start the engine.

Briefly, a carburetor of the present invention for an internal combustion engine has an air passage through which air is drawn into the engine, a throttle valve movable in the air passage for controlling flow of air therethrough, a source of fuel, a fuel passage through which fuel is drawn from the source to the air passage for mixing with air to produce an air-fuel mixture combusted in the engine, the fuel passage having an orifice at one end communicating with the fuel source, a metering rod having a diameter variable along its length, and means responsive to the movement of the throttle valve for positioning the metering rod in the orifice thereby to control the quantity of fuel drawn through the fuel passage, the positioning means further being responsive to a change in the engine vacuum level when a change in the load on the engine occurs to vary the position of the metering rod in the orifice and thereby the quantity of fuel drawn through the fuel passage. Means are provided for limiting the movement of the metering rod produced by the positioning means in response to a change in the engine vacuum level thereby to limit the variation in quantity of fuel drawn through the fuel passage when a change in engine vacuum level occurs. Means responsive to the engine vacuum level being less than a predetermined level produces a relatively greater movement in the position of the metering rod in the orifice than that allowed by the limiting means whereby a relatively greater quantity of fuel is drawn through the fuel passage during cranking of the engine. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
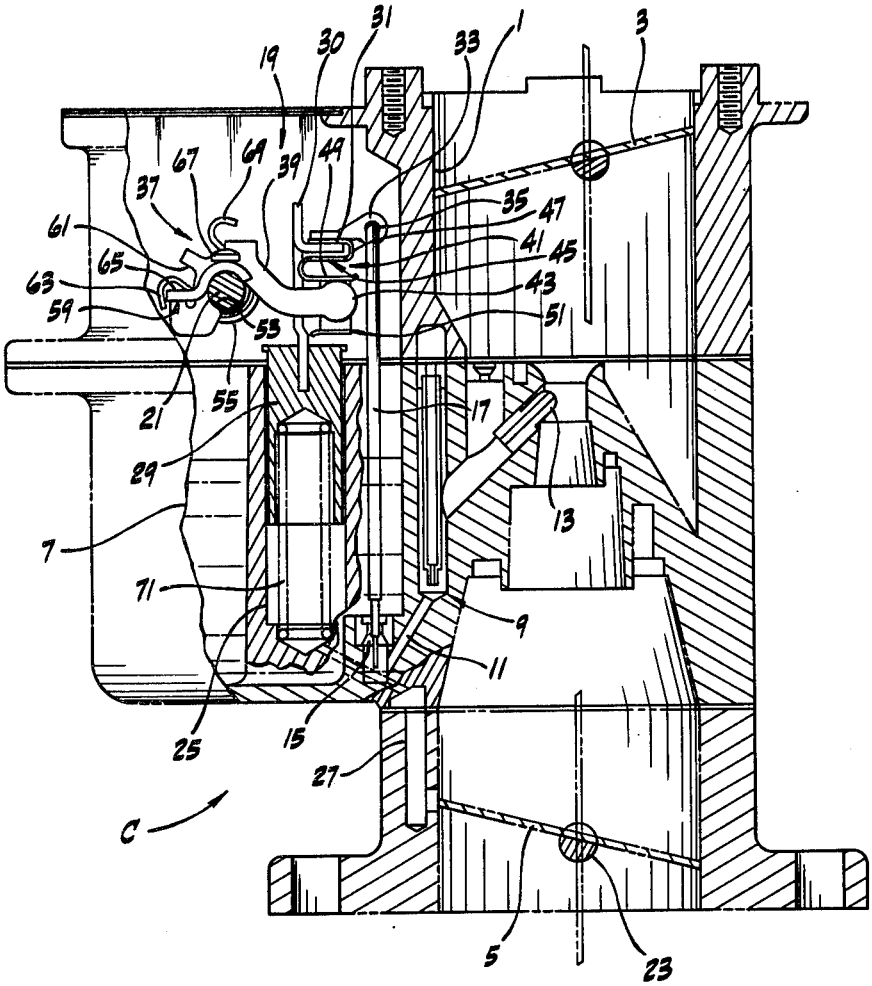
FIG. 1 is a side elevational view, in section, of a carburetor including means of the present invention for limiting movement of a fuel metering rod in response to a change in load on an engine and means of the present invention for producing relatively greater movement of the metering rod when the engine vacuum level is less than a predetermined level.

Referring now to the drawings, a carburetor, generally indicated C for an internal combustion engine (not shown) has an air passage 1 through which air is drawn into the engine. A choke valve 3 is positioned in the inlet of air passage 1 and a throttle valve 5 is positioned in the air passage downstream from its inlet. Both valves are movable between closed and open positions (as indicated by the solid and dashed line representations respectively), the movement of the valves controlling the flow of air through the air passage. A fuel bowl 7 provides a source of fuel and a fuel circuit generally indicated 9, is provided for delivery of fuel from the fuel bowl to the air passage. Fuel circuit 9 comprises a fuel passage 11 through which fuel is drawn from fuel bowl 7 to air passage 1, the fuel entering the air passage through a nozzle 13. The fuel passage has an orifice 15 at its entrant end which communicates with fuel bowl 7 and fuel flows from the fuel bowl into the fuel passage through the orifice.

A metering rod 17 has a diameter variable along its length. As shown in FIG. 1, the diameter of the metering rod is stepped at intervals along its length, although it will be understood that the metering rod may have a tapered diameter.

Means generally indicated 19, is responsive to the movement of throttle valve 5 for positioning metering rod 17 in orifice 15 to control the quantity of fuel drawn through fuel passage 11. Means 19 comprises a rotatable shaft 21 whose rotational movement is tied to that of the throttle valve by a linkage (not shown) which connects shafts 21 to a shaft 23 on which the throttle valve is mounted. Shaft 21 is conventionally referred to as a "counter" shaft and the construction of the linkage by which its movement is tied to that of throttle valve 5 is well known in the art. The positioning means is further responsive to a change in the engine vacuum level when a change in the load on the engine occurs to vary the position of the metering rod in the orifice. For this purpose, positioning means 19 further comprises a cylinder 25 to which a vacuum signal from the engine is supplied. This vacuum signal corresponds to the engine vacuum level. A passage 27 communicates with cylinder 25 and with the outlet of air passage 1 so engine vacuum is applied to the cylinder. A piston 29 is slidable in cylinder 25 in response to the vacuum signal and the piston has a stem 30 projecting upwardly from its upper face and metering rod 17 is carried by the stem for movement with the piston. As shown, stem 30 has an outwardly extending arm 31 and a hangar 33 rests atop this arm. The hangar has an eyelet 35 and the upper end of metering rod 17 is shaped to fit in this eyelet so the metering rod is suspended from hangar 33 with its lower, variable diameter end positioned in orifice 15.

Figure 3:
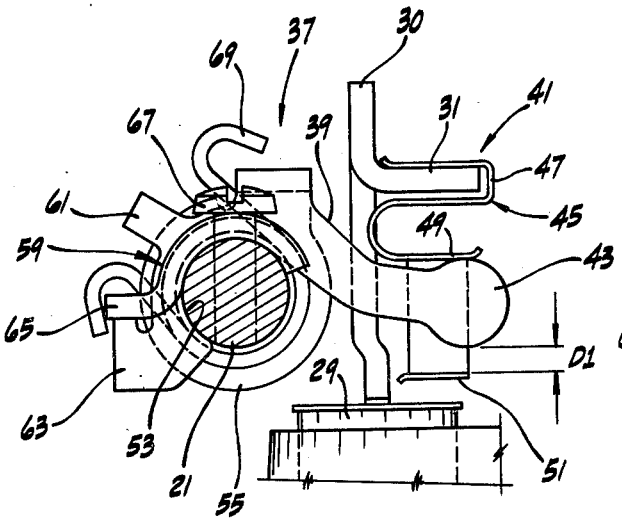
FIG. 3 is a side elevational view of the means shown in FIG. 2 illustrating the position of the means during curb idle.

The movement of the metering rod in the orifice produced in response to a change in the engine vacuum level is limited by means generally indicated 37. Means 37 comprises a lever 39 carried by shaft 21 and rotatable therewith and a bracket 41 carried by stem 30. The lever has a knob-shaped end 43 contacting bracket 41 to exert a force on the bracket to move the piston and the metering rod. Bracket 41 comprises a keeper 45 having a U-shaped arm 47 fitting over arm 31 of stem 30 whereby the bracket is carried by the stem. Further, keeper 45 has first and second spaced apart plates, 49 and 51 respectively, between which end 43 of lever 39 is held. Lever end 43 contacts the inner surface of one of the plates, as shaft 21 rotates in response to throttle valve 5 movement, to exert a force on piston 29 to move the piston and metering rod 15. As best shown in FIG. 3, piston 29 is free to move a distance D1, which corresponds to the distance between end 43 of lever 41 and the inner surface of the plate not in contact with the lever. Because end 43 of lever 39 is captured between the plates of the bracket, the movement of stem 30 and hence metering rod 17 is limited to the distance D1 when a change in engine load occurs.

Figure 2:
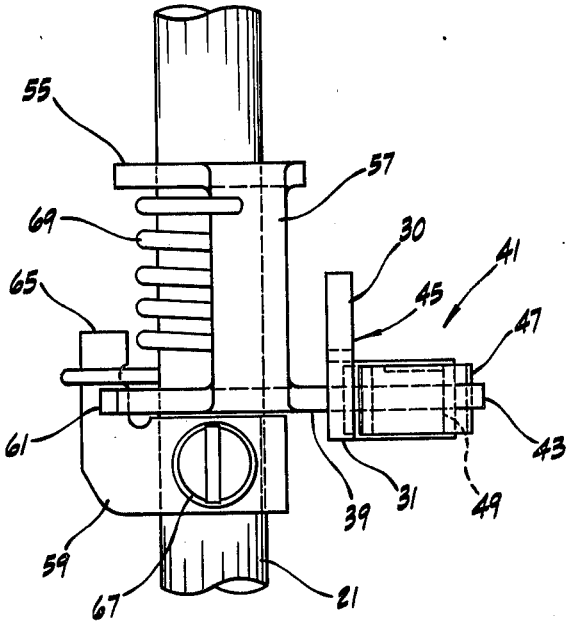
FIG. 2 is a top plan view of means of the present invention for limiting movement of a metering rod.

Lever 39 is rotatable about shaft 21 and has an arcuate surface 53 of the same diameter as that of shaft 21 for the lever to pivot on the shaft. As best shown in FIG. 2, a bearing collar 55 is received on shaft 21 and is rigidly attached to lever 39 by a bar 57 to form an assembly rotatable about the shaft. The other end of lever 39 is bifurcated and limiting means 37 further comprises a stop 59 against which one portion 61 of the bifurcated end comes in contact when lever 39 rotates in one direction about shaft 21 and against which the other portion 63 of the bifurcated end comes in contact when the lever rotates in the opposite direction about the shaft. The portions of the bifurcated end of lever 39 are separated by a gap and stop 59 comprises an arm 65 projecting through this gap. The stop has an arcuate surface whose diameter corresponds to that of shaft 21 and arm 65 extends parallel to the longitudinal axis of the shaft between the separated portions of the bifurcated end of the lever. The stop is secured to shaft 21 by a screw 67.

A torsion spring 69 (see FIG. 2) is received on shaft 21 and rests between lever 39 and bearing collar 55. The spring is seated against arm 65 of stop 61 and bears against bar 57 of the lever assembly to exert a rotational force on lever 39 in one direction (the clockwise direction) about shaft 21. Further, a bias spring 71 (see FIG. 1) is positioned in cylinder 25 and exerts a force on piston 29 which opposes the force exerted on the piston by lever 39. When the vacuum level in the engine on which carburetor C is installed exceeds a predetermined level which is, for example, 5 inches Hg., the force exerted on the piston by the bias spring is insufficient to overcome the force exerted on the piston by the lever and the piston moves in the cylinder in response to movement of the throttle valve or, when the throttle valve position remains substantially constant, and a change in the load on the engine occurs, to the limited extent corresponding to distance D1. When however, the engine vacuum is less than the predetermined level, for example, during cranking of the engine, the force exerted on the piston by the bias spring is sufficient to overcome the force exerted on the piston by the lever. This results in a net force being exerted on the lever and the lever rotates in the counterclockwise direction about shaft 21. This counterclockwise rotation of the lever moves the piston in the cylinder and the metering rod in the orifice a distance D2 (see FIG. 4) which distance is greater than the distance D1. For purposes of comparison, the dashed line position of plate 51 shown in FIG. 4 corresponds to the position of plate 51 shown in FIG. 3. The movement of stem 30, the distance D2, results in metering rod 17 being moved a greater distance with respect to orifice 15 than occurs when the rod moves only distance D1. A smaller diameter step of the metering rod is therefore positioned in the orifice thereby allowing more fuel to flow into fuel passage 11. Thus, torsion spring 69 and bias spring 71 comprise means responsive to the engine vacuum level being less than a predetermined level for producing a relatively greater movement of metering rod 17 in the orifice than that allowed by limiting means 39 so a relatively greater quantity of fuel is drawn through the fuel passage during cranking of the engine. This results in a sufficiently rich air-fuel mixture being produced in air passage 1 for quick starting of the engine and reduced levels of emission.

Figure 4:
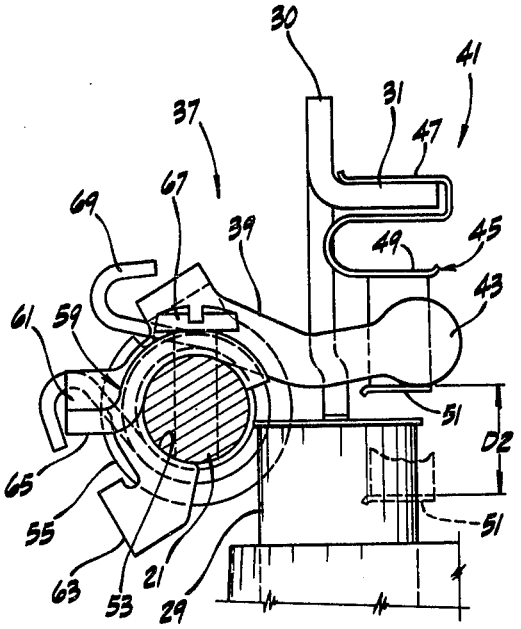
FIG. 4 is a side elevational view of the means shown in FIG. 2 illustrating the position of the means during cranking of an engine.
Figure 5:
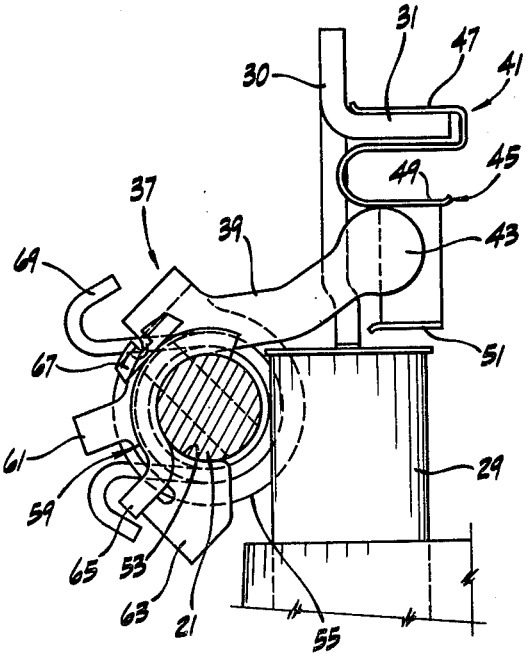
FIG. 5 is a side elevational view of the means shown in FIG. 2 illustrating the position of the means when an engine is operating at wide-open throttle.

FIGS. 3–5 illustrate the operation of the above described structure. For convenience, hangar 33 and metering rod 17 are not shown in these figures, but it will be understood in view of the previous description that the movement of the metering rod in orifice 15 corresponds to the movement of piston 29 in cylinder 25. FIG. 3 represents the curb idle condition for an engine. At curb idle, the engine vacuum level exceeds the predetermined level, i.e. 5 in. Hg. Spring 69 loads lever 39 to rotate it clockwise about shaft 21 until end portion 63 of the lever contacts arm 65 of stop 59. The engine vacuum level is supplied to cylinder 25 and applied to piston 29 so that the piston moves against bias spring 71 into the cylinder. This movement is limited by means 37 and specifically the inner surface of plate 49 of keeper 45 contacting end 43 of the lever. As throttle valve 5 opens to its wide-open position, as shown in FIG. 5 shaft 21 rotates counterclockwise and end 43 of lever 39 exerts a force on the piston to raise it in cylinder 25 and metering rod 17 is raised in orifice 15 to admit more fuel into fuel passage 11. The force exerted on lever 39 by spring 69 is such that the entire structure comprising the positioning means and the limiting means moves as one, solid piece.

When the engine is operating at a constant speed, so the position of throttle valve 5 is substantially constant and shaft 21 is at some position intermediate the curb idle and wide open throttle positions, and the load on the engine changes, for example, the vehicle starts up a hill, the engine vacuum level decreases. The force exerted on the piston by the bias spring now forces the piston upwardly, but this upward movement is limited by the inner surface of plate 51 contacting lever end 43. If the reduced engine vacuum level still exceeds the predetermined level, the downward force exerted on the piston by lever 39 and the engine vacuum is greater than the upward force exerted on the piston by the bias spring and the upward movement of the piston is halted so that metering rod 29 rises only distance D1, which distance is, for example, 0.050 inches (0.13 cm), in orifice 15.

If the reduced engine vacuum level is less than the predetermined level, the upward force exerted on the piston by the bias spring is greater than the downward force exerted on the piston by lever 39 and the engine vacuum. Lever 39 is then rotated counterclockwise, as shown in FIG. 4, until end portion 61 of the bifurcated end of the lever contacts arm 65 of stop 59. Metering rod 15 rises in orifice 11 a distance which, at a maximum is the distance D2, but which, in any event, is a distance greater than distance D1. Distance D2 is, for example, 0.430 inches (1.09 cm). The distance D2 of metering rod movement occurs when the engine is shut off and there is no engine vacuum. This permits the metering rod to be so elevated in the orifice that enough fuel is drawn through fuel passage 11, when the engine is started, to produce a sufficiently rich air-fuel mixture to start the engine.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

I claim:

1. In a carburetor for an internal combustion engine, said carburetor having an air passage through which air is drawn into the engine, a throttle valve movable in said air passage for controlling flow of air therethrough, a source of fuel, a fuel passage through which fuel is drawn from said source to said air passage for mixing with air to produce an air-fuel mixture combusted in said engine, said fuel passage having an orifice at one end communicating with said fuel source, a metering rod having a diameter variable along its length, means responsive to the movement of said throttle valve for positioning said metering rod in said orifice thereby to control the quantity of fuel drawn through said fuel passage, said positioning means further being responsive to a change in the engine vacuum level when a change in the load on said engine occurs to vary the position of said metering rod in said orifice and thereby the quantity of fuel drawn through said fuel passage, the improvement comprising:

throttle valve controlled means for positively limiting the opening movement of said metering rod produced in response to a change in the engine vacuum level at intermediate throttle valve positions thereby to limit the variation in quantity of fuel drawn through said fuel passage when a change in engine vacuum level occurs; and means responsive to the engine vacuum level being less than a predetermined level for overriding said limiting means and producing a relatively greater movement in the position of said metering rod in said orifice than that allowed by said limiting means whereby a relatively greater quantity of fuel is drawn through said fuel passage during cranking of the engine.

2. In a carburetor for an internal combustion engine, said carburetor having an air passage through which air is drawn into the engine, a throttle valve movable in said air passage for controlling flow of air therethrough, a source of fuel, a fuel passage through which fuel is drawn from said source to said air passage for mixing with air to produce an air-fuel mixture combusted in said engine, said fuel passage having an orifice at one end communicating with said fuel source, a metering rod having a diameter variable along its length, means responsive to the movement of said throttle valve for positioning said metering rod in said orifice thereby to control the quantity of fuel drawn through said fuel passage, said positioning means further being responsive to a change in the engine vacuum level when a change in the load on said engine occurs to vary the position of said metering rod in said orifice and thereby the quantity of fuel drawn through said fuel passage and said positioning means comprising a shaft adapted for rotational movement by said throttle valve, a cylinder to which a vacuum signal from the engine is supplied, said vacuum signal corresponding to the engine vacuum level, and a piston movable in said cylinder in response to said vacuum signal, said piston having a stem on which said metering rod is carried for movement with said piston, the improvement comprising:

means for limiting the movement of said metering rod produced in response to a change in the engine vacuum level thereby to limit the variation in quantity of fuel drawn through said fuel passage when a change in engine vacuum level occurs, said limiting means comprising a lever carried by said shaft, said lever being rotatable with said shaft and rotatable about said shaft, and a bracket carried by said stem, one end of said lever contacting said bracket and exerting a force thereon to move said piston in said cylinder and thereby said metering rod in said orifice, said bracket including a keeper having first and second spaced apart plates between which said one end of said lever is held, said one end of said lever contacting the inner surface of one of said plates to exert said force on said piston and move said piston and said metering rod, said piston being free to move a distance corresponding to the distance between said one end of said lever and the inner surface of said plate not in contact with said lever end thereby to limit the movement of said piston and said metering rod in response to a change in engine vacuum; and means responsive to the engine vacuum level being less than a predetermined level for producing a relatively greater movement in the position of said metering rod in said orifice than that allowed by said limiting means whereby a relatively greater quantity of fuel is drawn through said fuel passage during cranking of the engine, said vacuum responsive means comprising a torsion spring received on said shaft for exerting a rotational force on said lever in one direction about said shaft, the force exerted on said lever by said spring being transmitted on said piston to move said piston and said metering rod.

3. In a carburetor for an internal combustion engine, said carburetor having an air passage through which air is drawn into the engine, a throttle valve movable in said air passage for controlling flow of air therethrough, a source of fuel, a fuel passage through which fuel is drawn from said source to said air passage for mixing with air to produce an air-fuel mixture combusted in said engine, said fuel passage having an orifice at one end communicating with said fuel source, a metering rod having a diameter variable along its length, means responsive to the movement of said throttle valve for positioning said metering rod in said orifice thereby to control the quantity of fuel drawn through said fuel passage, said positioning means comprising a shaft adapted for rotational movement by said throttle valve, a cylinder to which a vacuum signal from the engine is supplied, said vacuum signal corresponding to the engine vacuum level, and a piston movable in said cylinder in response to said vacuum signal, said piston having a stem on which said metering rod is carried for movement with said piston, said positioning means further being responsive to a change in the engine vacuum level when a change in the load on said engine occurs to vary the position of said metering rod in said orifice and thereby the quantity of fuel drawn through said fuel passage, the improvement comprising:

means for limiting the opening movement of said metering rod produced in response to a change in the engine vacuum level thereby to limit the variation in quantity of fuel drawn through said fuel passage when a change in engine vacuum level occurs, said limiting means comprising a lever carried by said shaft and rotatable therewith and a bracket carried by said stem, one end of said lever contacting said bracket and exerting a force thereon to move said piston in said cylinder and thereby said metering rod in said orifice; and means responsive to the engine vacuum level being less than a predetermined level for producing a relatively greater movement in the position of said metering rod in said orifice than that allowed by said limiting means whereby a relatively greater quantity of fuel is drawn through said fuel passage durng cranking of the engine.

4. The improvement as set forth in claim 1 wherein said bracket comprises a keeper having first and second spaced apart plates between which said one end of said lever is held, said one end of said lever contacting the inner surface of one of said plates to exert said force on said piston and move said piston and said metering rod, and wherein said piston is free to move a distance corresponding to the distance between said one end of said lever and the inner surface of said plate not in contact with said lever end thereby to limit the movement of said piston and said metering rod in response to a change in engine vacuum.

5. The improvement as set forth in claim 4 wherein said lever is rotatable about said shaft and said vacuum responsive means comprises a torsion spring received on said shaft for exerting a rotational force on said lever in one direction about said shaft, the force exerted on said lever by said spring being transmitted to said piston to move said piston and said metering rod.

6. The improvement as set forth in claim 5 wherein said vacuum responsive means further comprises a bias spring positioned in said cylinder and exerting a force on said piston opposing the force exerted thereon by said lever, said force exerted on said piston by said bias spring being insufficient to overcome the force exerted thereon by said lever when the engine vacuum level exceeds said predetermined level whereby said piston moves in said cylinder in response to the movement of said throttle valve and, when said throttle valve position in said air passage remains substantially constant, to the limited extent corresponding to the distance between said one end of said lever and said plate not in contact with said lever end, said force exerted by said bias spring on said piston being sufficient to overcome the force exerted thereon by said lever when said engine vacuum level is less than said predetermined level whereby a net force is exerted on said lever to rotate said lever in an opposite direction about said shaft, the distance to which said piston is movable in said cylinder when said lever is rotated in said opposite direction being greater than the distance between said one end of said lever and the plate not in contact therewith.

7. The improvement as set forth in claim 6 wherein the other end of said lever is bifurcated and said limiting means includes a stop against which one portion of said bifurcated end comes in contact when said lever is rotated in said one direction about said shaft and against which the other portion of said bifurcated end comes in contact when said lever is rotated in the opposite direction about said shaft.

8. The improvement as set forth in claim 7 wherein said portions of said bifurcated end of said lever are separated by a gap and said stop comprises an arm carried by said shaft and projecting through said gap.

* * * * *